US008033833B1

(12) United States Patent
Lai

(10) Patent No.: US 8,033,833 B1
(45) Date of Patent: Oct. 11, 2011

(54) ROTATABLE CONNECTOR

(75) Inventor: Jin-Shi Lai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/982,897

(22) Filed: Dec. 31, 2010

(30) Foreign Application Priority Data

Dec. 6, 2010 (CN) ..... 2010 1 0574512

(51) Int. Cl.
*H01R 39/00* (2006.01)

(52) U.S. Cl. ..... 439/5; 439/21

(58) Field of Classification Search ..... 439/5, 21, 439/22, 13
See application file for complete search history.

(56) References Cited

U.S. PATENT DOCUMENTS

| | | | | |
|---|---|---|---|---|
| 6,663,395 | B2 * | 12/2003 | Sobhani | 439/21 |
| 7,192,303 | B2 * | 3/2007 | Kohen | 439/537 |
| 7,726,972 | B1 * | 6/2010 | Brandenburg et al. | 439/5 |
| 2005/0148241 | A1 * | 7/2005 | Kohen | 439/620 |

* cited by examiner

*Primary Examiner* — Hien Vu
(74) *Attorney, Agent, or Firm* — Altis Law Group, Inc.

(57) ABSTRACT

A rotatable connector includes a first rotating member and a second rotating member. The first rotating member includes a first surface and an opposite second surface. The first surface forms first pins, and the second surface forms fixing bodies each comprising a first portion and a second portion. The first portion and the second portion cooperatively define a latching groove therebetween. The second rotating member includes a third surface opposing the first rotating member and an opposite fourth surface. The third surface forms circular latching bodies rotatably retained within the latching groove. The fourth surface forms second pins. The fixing bodies and the latching bodies cooperatively define cavities fully filled in electrical conductive material. The wires that are respectively fixed to the first pins and the second pins are capable of being electrically connected by the electrical conductive material.

4 Claims, 3 Drawing Sheets

ROTATABLE CONNECTOR

BACKGROUND

1. Technical Field

The present disclosure relates to a rotatable connector that electrically connects wires together.

2. Description of Related Art

A conventional rotating connector includes a first rotating part, a second rotating part, and a control unit for controlling the second rotating part to rotate relative to the first rotating part. The control unit is electrically connected to the two rotating parts with wires. However, when the second rotating part rotates relative to the first rotating part, the wires can be easily broken if twisted. Thus, the rotating connector is inconvenient in use.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are now described in detail, with reference to the accompanying drawings.

Figure 1:
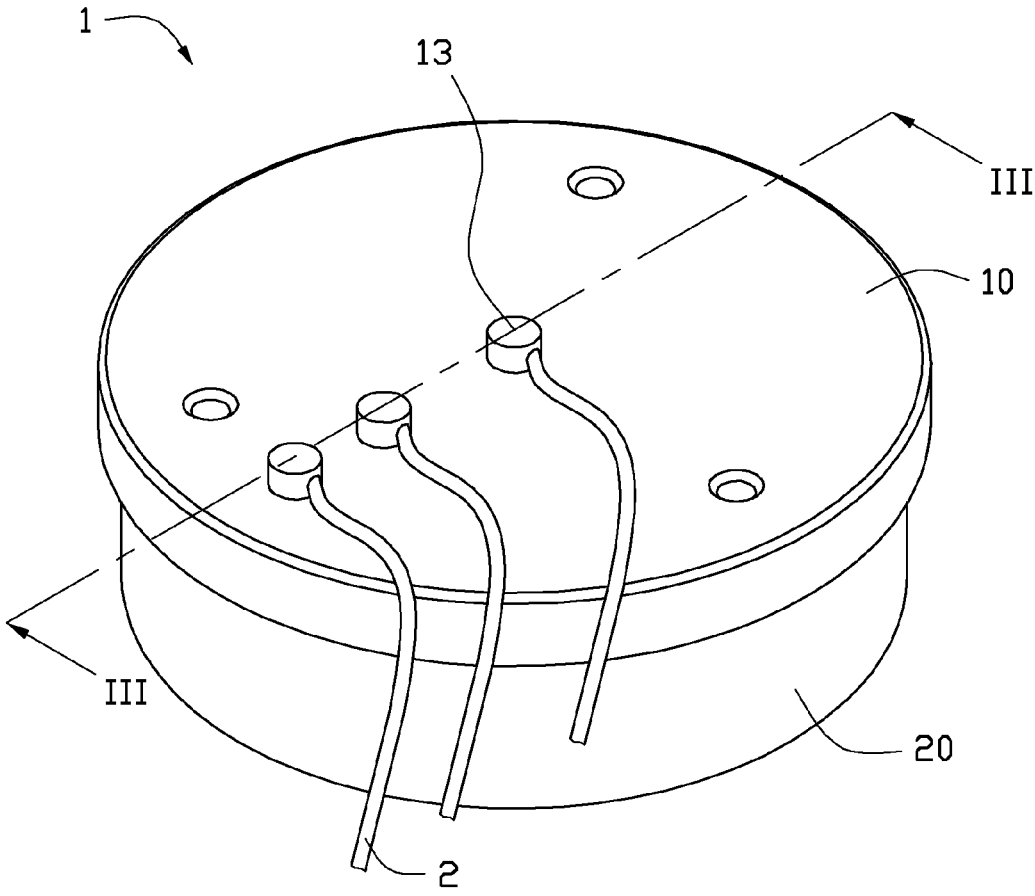
FIG. 1 is an isometric view of a rotatable connector according to an exemplary embodiment.

Referring to FIG. 1, a rotatable connector 1 according to an exemplary embodiment is illustrated. The rotatable connector 1 includes a first rotating member 10 and a second rotating member 20 rotatably coupled to each other. A number of wires 2 are respectively fixed to the first rotating member 10 and the second rotating member 20 (see FIG. 3). When the first rotating member 10 rotates relative to the second rotating member 20, the wires 2 will not be twisted.

Figure 2:
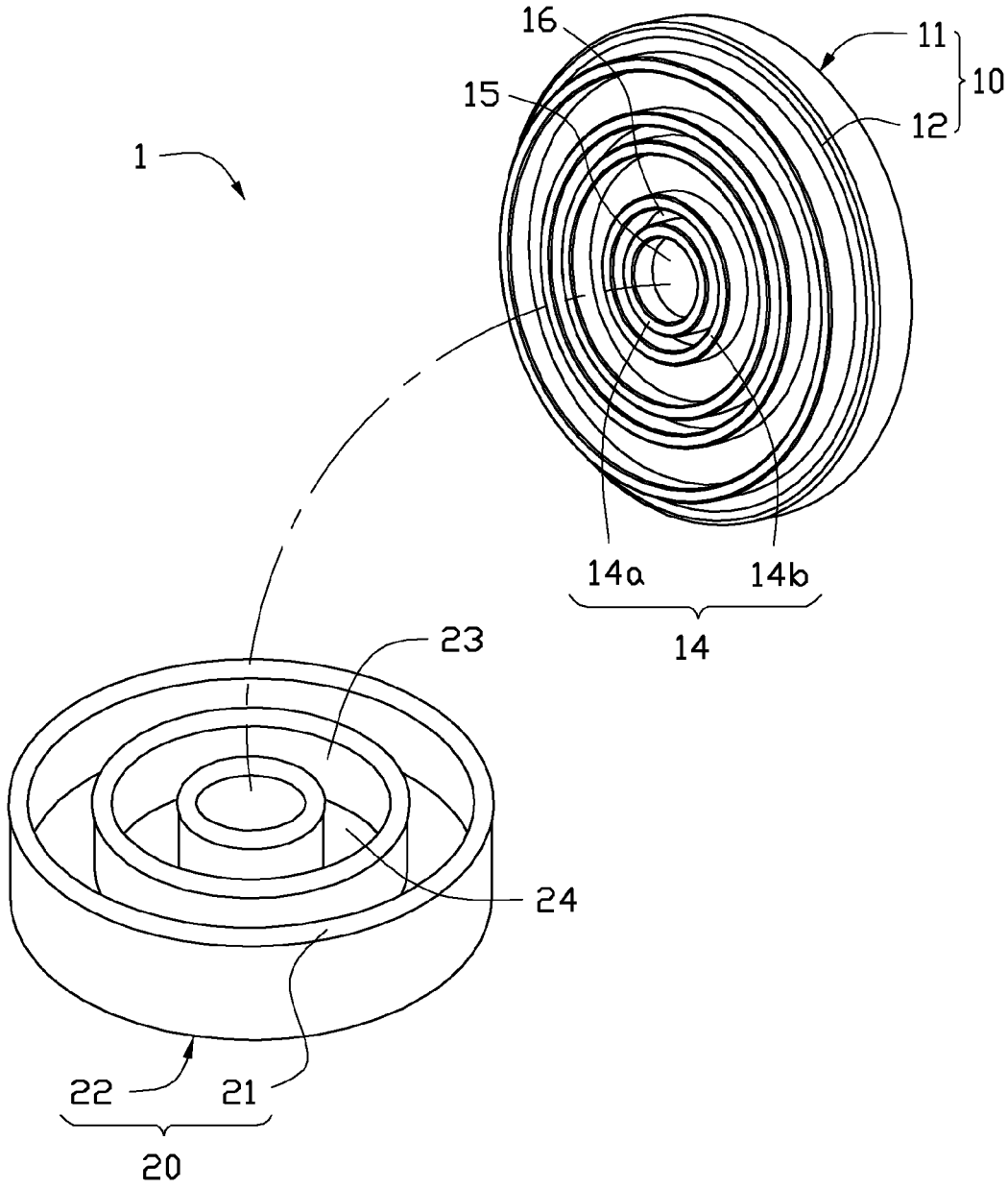
FIG. 2 is an exploded view of the rotatable connector of FIG. 1.
Figure 3:
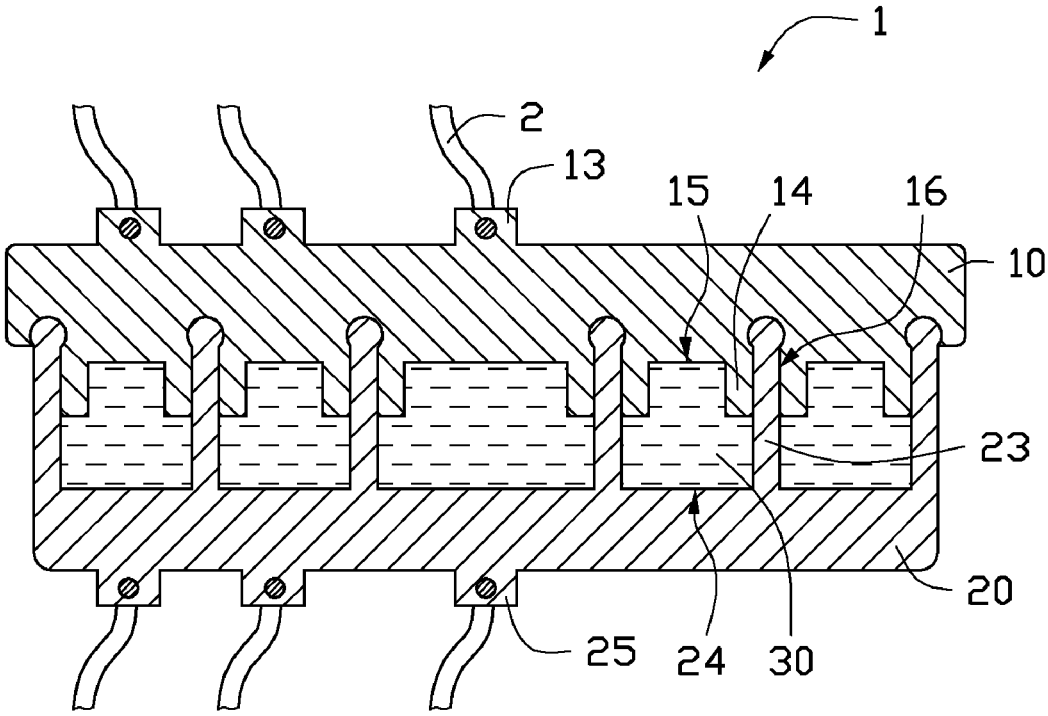
FIG. 3 is a schematic cross-sectional view of the rotatable connector taken along the line III-III of FIG. 1.

Referring also to FIGS. 2 and 3, the first rotating member 10 is disc-shaped and includes a first surface 11 and an opposite second surface 12. The first surface 11 forms three first contact pins 13 thereon, and the second surface 12 forms three fixing bodies 14 thereon. The fixing bodies 14 are ring-shaped and each includes a first portion 14*a* and a second portion 14*b*. The first portion 14*a* and the second portion 14*b* cooperatively define an annular groove 16 there between. The second surface 12 further mounts three conducting layers 15 respectively contacting with one of the three first pins 13. The fixing bodies 14 insulate the conducting layers 15 from each other.

The second rotating member 20 includes a third surface 21 opposing the first rotating member 10 and an opposite fourth surface 22. The third surface 21 forms three latching bodies 23, and the fourth surface 22 forms three second pins 25 thereon. The third surface 23 further mounts three second conducting layers 24 respectively contacting with one of the three second pins 25. The first pins 13 and the second pins 25 are made of electrical conductive material. The latching bodies 23 are shaped to match into the latching grooves 16 of the first rotating member 10. In the embodiment, the latching grooves 16 and the latching bodies 23 are coaxial to each other, and the cross-sections of the latching grooves 16 and the latching bodies 23 are substantially matchstick shaped.

The latching bodies 23 are fit into the latching grooves 16, and thus the second rotating member 20 is rotatably connected to the first rotating member 10. The fixing bodies 14 and the latching bodies 23 cooperatively define three isolated cavities 30. The rotatable connector 1 further includes a number of electrical conductive materials filled in the cavities 30.

When in use, the wires 2 that are respectively fixed to the first pins 13 and second pins 25 can be electrically connected by the electrical conductive materials. When the first rotating member 10 rotates relative to the second rotating member 20, the wires 2 will not be twisted.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A rotatable connector comprising:

a first rotating member comprising a first surface and an opposite second surface, wherein the first surface forms a plurality of first pins extending outwardly thereon and connected to wires, and the second surface forms a plurality of circular wall fixing bodies, each of the circular wall fixing bodies comprising a first circular wall portion and a second circular wall portion, wherein the first circular wall portion and the second circular wall portion cooperatively define an latching annular groove therebetween; and a second rotating member opposing the first rotating member, the second rotating member comprising a third surface and an opposite fourth surface, wherein the third surface forms a plurality of circular wall latching bodies, each of the circular wall latching bodies corresponding to the plurality of circular wall fixing bodies, and each rotatably retained within one of the latching annular grooves, and the fourth surface forms a plurality of second pins extending outwardly thereon and connected with wires, wherein:

the circular wall fixing bodies and the circular wall latching bodies cooperatively fitted into each other and define a plurality of cavities fully filled in electrical conductive material, and thus the wires respectively fixed to the first pins and the second pins is capable of being electrically connected by the electrical conductive material; the second surface mounts a plurality of conducting layers respectively contacting with one of the first pins, and the third surface mounts a plurality of second conducting layers respectively contacting with one of the second pins.

2. The rotatable connector as described in claim 1, wherein the numbers of the first pins, the fixing bodies, the first conducting layers, the latching bodies, the second pins, and the second conducting layers are three.

3. The rotatable connector as described in claim 1, wherein the latching grooves and the latching bodies are coaxial with each other.

4. The rotatable connector as described in claim 1, wherein the cross-sections of the latching grooves and the latching bodies are substantially matchstick shaped.

* * * * *